US007971746B2

(12) United States Patent
Takaoka

(10) Patent No.: US 7,971,746 B2
(45) Date of Patent: Jul. 5, 2011

(54) THERMALLY INSULATED HOUSING

(75) Inventor: Mitsuyuki Takaoka, Toyoake (JP)

(73) Assignee: Hoshizaki Denki Kabushiki Kaisha, Aichi (JP)

( * ) Notice: Subject to any disclaimer, the term of this patent is extended or adjusted under 35 U.S.C. 154(b) by 1351 days.

(21) Appl. No.: 11/372,039

(22) Filed: Mar. 10, 2006

(65) Prior Publication Data

US 2006/0201185 A1 Sep. 14, 2006

(30) Foreign Application Priority Data

Mar. 14, 2005 (JP) ..... 2005-071285

(51) Int. Cl.
*A47J 39/00* (2006.01)
*F25D 23/00* (2006.01)
*F17C 1/00* (2006.01)

(52) U.S. Cl. ..... 220/592.25; 220/592.03; 220/560.15

(58) Field of Classification Search ..... 220/592.25, 220/592.03, 592.1, 902, 560.15, 680, 677, 220/682, 691; 312/406, 406.2; 52/478, 416, 52/459, 518

See application file for complete search history.

(56) References Cited

U.S. PATENT DOCUMENTS

| | | | | |
|---|---|---|---|---|
| 5,997,076 | A * | 12/1999 | Ehrlich | 296/186.1 |
| 6,112,851 | A * | 9/2000 | Sugimoto et al. | 181/287 |
| 7,185,509 | B2 * | 3/2007 | Lee et al. | 62/419 |
| 2004/0031794 | A1 * | 2/2004 | Bucher et al. | 220/4.01 |

FOREIGN PATENT DOCUMENTS

| | | |
|---|---|---|
| JP | 46-13299 | 5/1971 |
| JP | 51-116093 | 7/1982 |
| JP | 57-116093 | 7/1982 |
| JP | 61-24869 | 7/1986 |
| JP | 63-210589 | 9/1988 |
| JP | 4-53191 | 5/1992 |
| JP | 6-300429 | 10/1994 |
| JP | 9-203581 | 8/1997 |
| JP | 10-78283 | 3/1998 |
| JP | 10-78284 | 3/1998 |
| JP | 11-325709 | 11/1999 |
| JP | 2001-116440 | 4/2001 |
| JP | 3195259 | 6/2001 |
| JP | 2001-263927 | 9/2001 |

OTHER PUBLICATIONS

Japanese Office Action issued Jul. 31, 2008 in Japanese Application No. 2005-071285.

* cited by examiner

*Primary Examiner* — Anthony Stashick
*Assistant Examiner* — Shawn M Braden
(74) *Attorney, Agent, or Firm* — Wenderoth, Lind & Ponack, L.L.P.

(57) ABSTRACT

A back surface of an outer case is formed by mutually overlapping left and right back panels. The overlapping edges on the front side and backside of the panels may be bent toward the opposite side at a blunt angle. A joint between the back panels is established in which the overlapping edge of one back panel is pressed against the overlapping edge of the other back panel. Spacers are mounted between the outer and inner case such that the overlapping edges are put in close contact with each other. The bends are deformed in order to prevent leakage from the joint after the injection of foam liquid. Due to the pressure of the foam, both of the overlapping edges are placed in closer contact while deforming the bends to be substantially flat. Consequently, the sealing properties of the joint after the completion of the thermally insulated housing are secured.

8 Claims, 9 Drawing Sheets

THERMALLY INSULATED HOUSING

BACKGROUND OF THE INVENTION

1. Field of the Invention

The present invention relates to a thermally insulated housing for configuring the body of a cooling storage unit and the like, and a manufacturing method thereof.

2. Description of the Prior Art

There is a known example of a thermally insulated housing for configuring the body of a refrigerator described in Japanese Laid-Open Patent No. 6-300429. This example has an outer shell constituted by including an inner case housed at a predetermined interval within an outer case. Assembling multiple panels together forms the cases. The outer shell is then completed by charging foam insulation between the inner and outer cases in the state of having the cases set in a foaming jig.

In the situation of a large-size refrigerator for business or professional use, for example, the back surface in particular of the outer case may have a relatively large surface area. Therefore, there is a known refrigerator having a back surface formed by joining two panels together via mutually overlapping edges. As for a method of sealing the joint between both of the panels, a sponge is sandwiched between the overlapping edges of the panels and the assembly is riveted at appropriate intervals.

However, according to this conventional method, the work is troublesome because it is necessary to affix the sponge and to further rivet the assembly. In addition, the sponge may not be sufficiently compressed at locations distant from a riveted position. Therefore, there is a possibility of absorbing the liquid foaming agent when the foam is charged. This could have the opposite effect of widening the gap between the joint due to secondary foaming and the like.

SUMMARY OF THE INVENTION

A thermally insulated housing of the present invention may be manufactured as follows. With regard to the foaming process, an outer shell having an inner case, housed at a predetermined spacing interval within an outer case, is set within a foaming jig. The outer shell is in a state of having the foaming jig in contact with portions of the outer shell, particularly with an outer surface of the outer case and an inner surface of the inner case. Foam liquid is then injected between the outer case and the inner case while the outer shell is in this state. In this situation, on the surface(s) of the outer case and/or the inner case having multiple panels joined thereon, an overlapping edge of a front side panel of the adjacent panels is pressed against the corresponding overlapping edge of a backside panel. Spacers interact with the surface(s) so as to constitute a state of having both of the overlapping edges in close contact with each other while possibly deforming via bending. As a result, this inhibits the foam liquid from leaking through the overlapping joint. Thereafter, foam insulation is foamed in between the inner and the outer cases. However, as both of the overlapping edges are pressed by the foaming jig, they acquire a closer contact with one another while bending further under the pressure of the foam. Consequently, the sealing properties are secured for the overlapping joint of the panels during and after the manufacturing of the thermally insulated housing.

To be more specific, it is possible to secure the sealing properties of the joint between the panels without using any particular sealant or any additional fasteners such as rivets.

This allows the manufacturing of the thermally insulated housing at a relatively low cost.

DETAILED DESCRIPTION OF THE PREFERRED EMBODIMENTS

Hereafter, embodiments of the present invention will be described in detail with reference to the attached drawings.

First Embodiment

A first embodiment of the present invention will be described by referencing FIGS. 1 to 6. This embodiment exemplifies a four-door refrigerator configured for business or commercial use.

Figure 1:
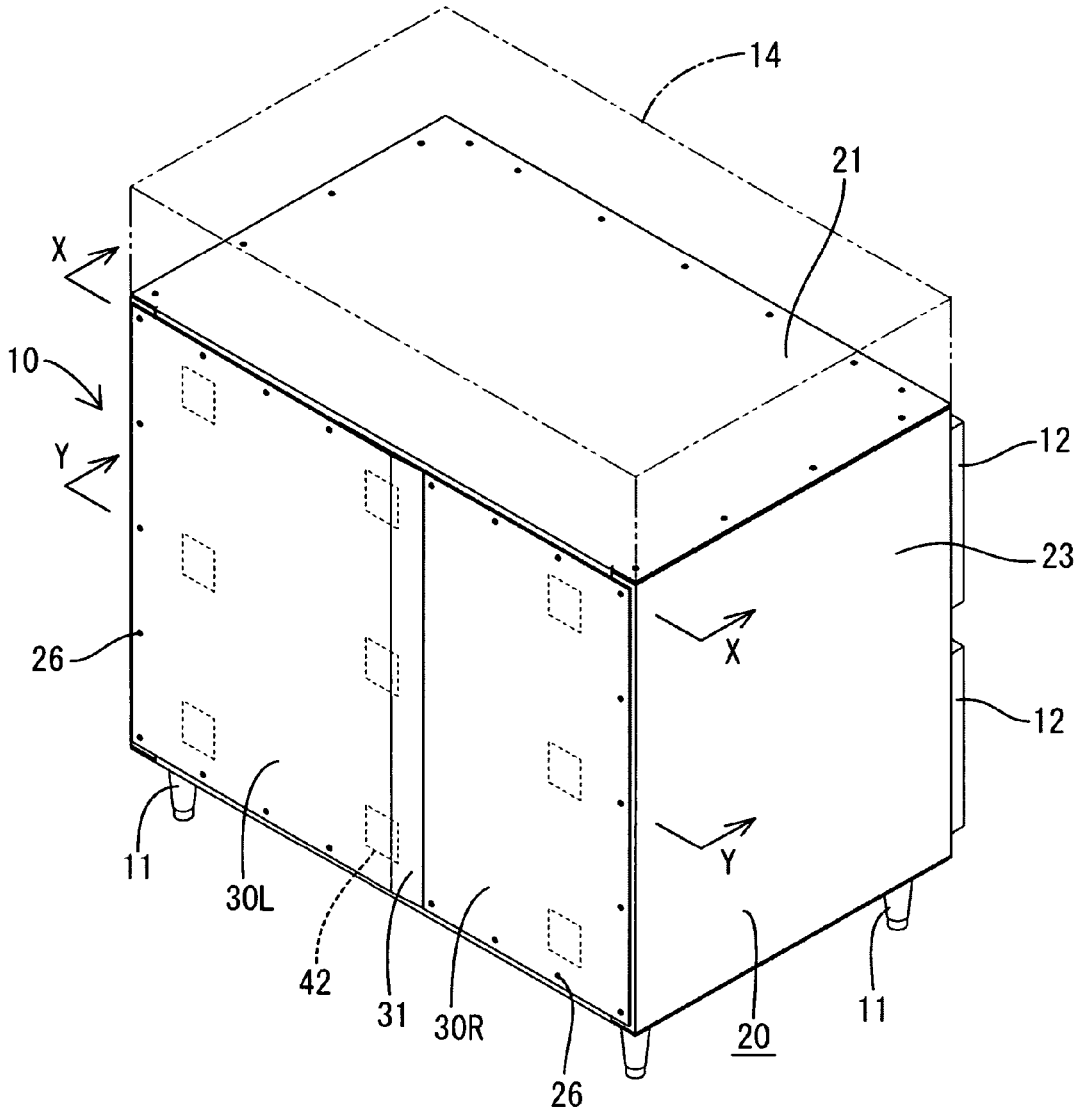
FIG. 1 is an external perspective view of a thermally insulated housing according to a first embodiment of the present invention.

In FIG. 1, reference numeral 10 denotes a thermally insulated housing with an anterior opening configuring a body of a refrigerator. Legs 11 are provided at four corners of the bottom surface and they support the refrigerator. The anterior opening of the thermally insulated housing 10 may be divided into four entrances, though this is not clearly shown in this view. Each entrance may be provided with a thermally insulated door 12 so as to be opened and closed. A machine room 14 is formed on a top surface of the thermally insulated housing 10 by assembling multiple panels. The machine room 14 may have a refrigeration unit and the like housed therein.

Next, the structure and a manufacturing process for the thermally insulated housing 10 will be described.

In general terms, in order to form the thermally insulated housing 10 of this embodiment an inner case 40 is housed at a predetermined interval within an outer case 20. The cases form an outer shell 15 consisting of a double case with an anterior opening. After the outer shell 15 is set in a foaming jig HJ, foam insulation 45, such as a foaming polyurethane resin, is foamed and charged in between the outer and inner cases 20 and 40.

Figure 2:
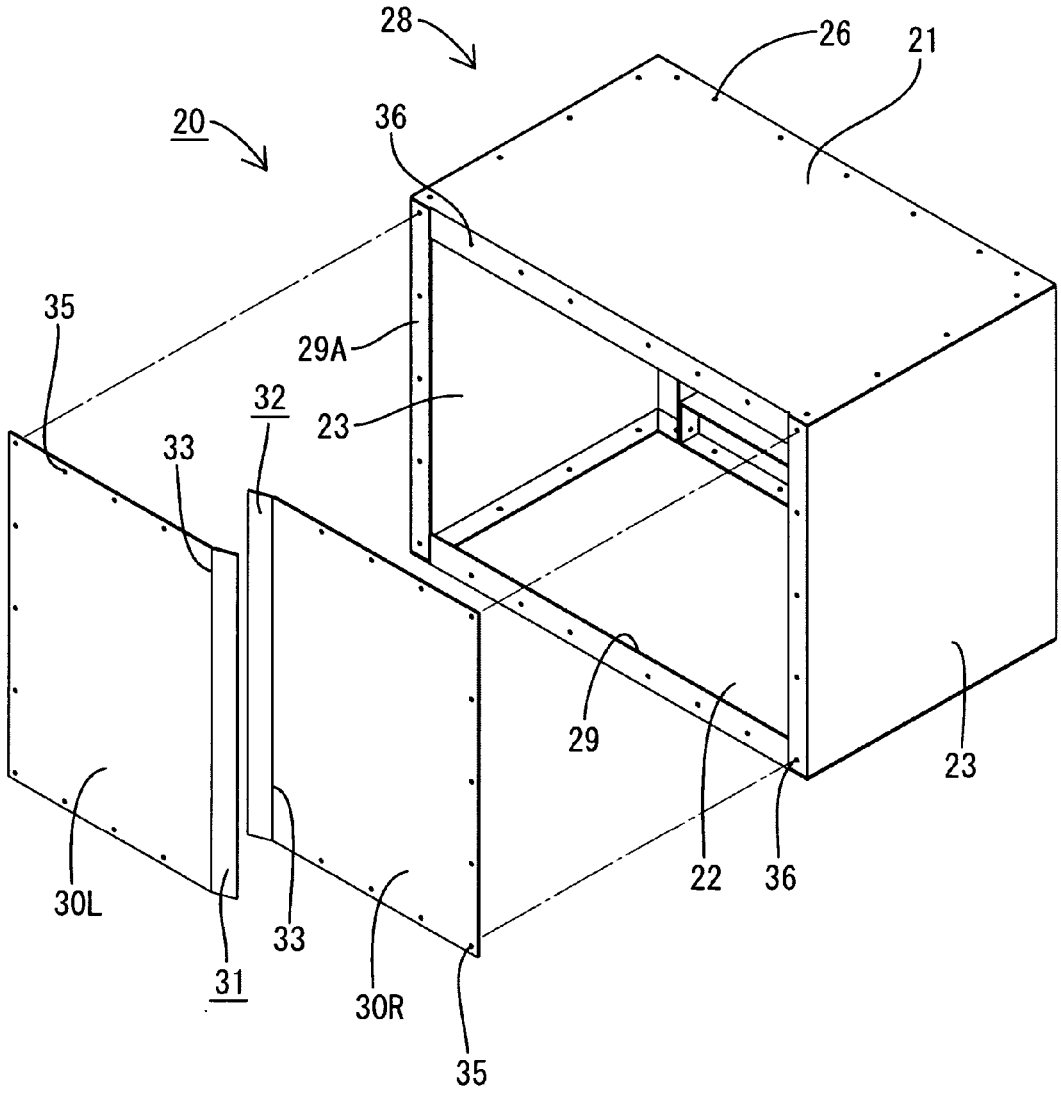
FIG. 2 is an exploded perspective view of an outer case.
Figure 3:
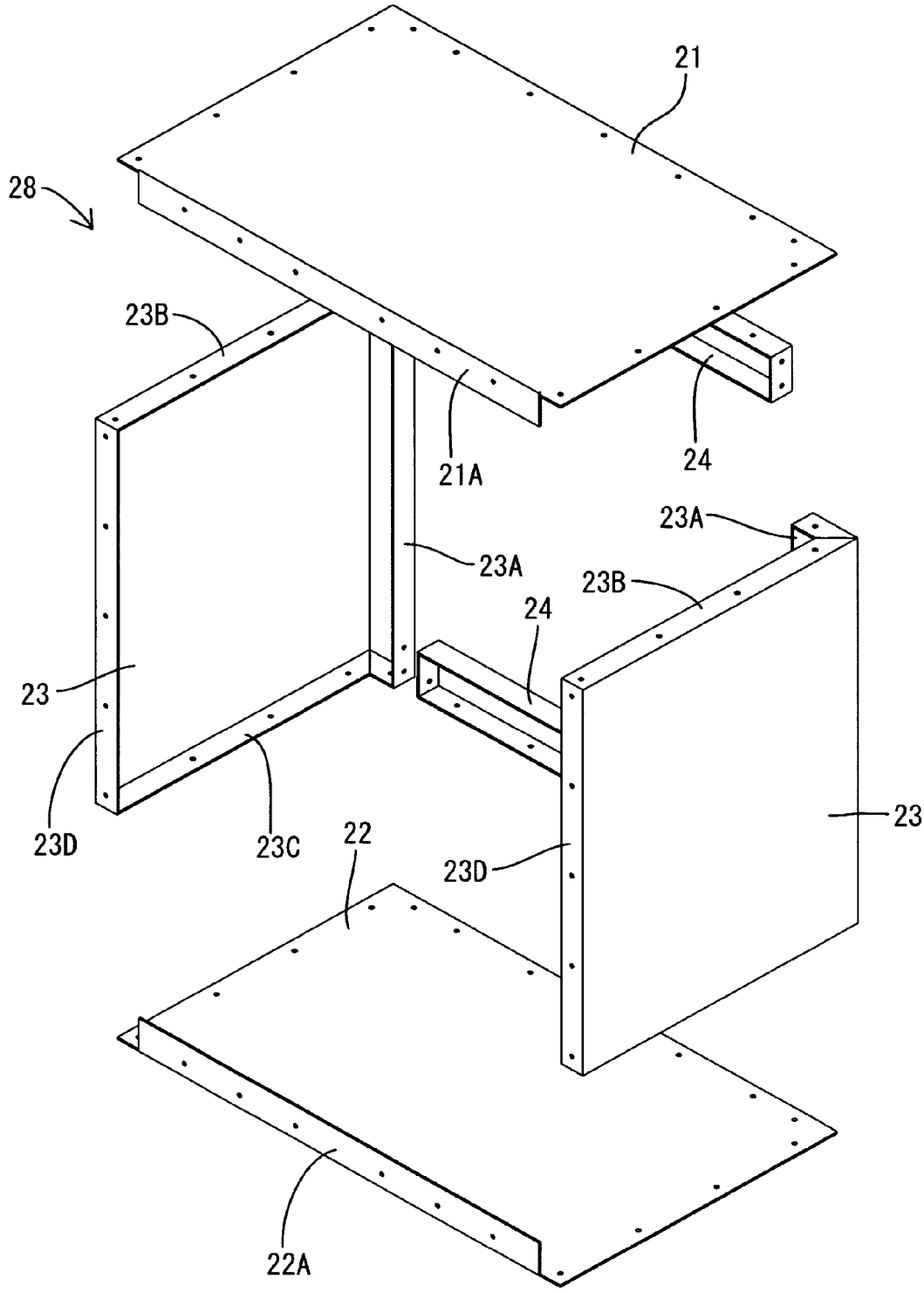
FIG. 3 is an exploded perspective view of an outer case body.

As shown in FIGS. 2 and 3, the outer case 20 is configured by a top panel 21, a bottom panel 22, right and left side panels 23, upper and lower frames 24, and a back panel divided into two pieces, 30L and 30R, all respectively composed of stainless steel plates.

The top panel 21 and bottom panel 22 are planar and have a downward flange 21A and an upward flange 22A formed on the irrespective posterior edges. The right and left side panels 23 are formed similar to shallow dishes, and their respective anterior edges 23A are bent inward at a right angle. The upper and lower frames 24 are formed similar to boxes, laterally long and thin, and opened on a posterior surface side.

As shown in FIG. 3, the frames 24 are respectively positioned at the upper and lower ends of the anterior edges 23A of the right and left side panels 23. The top panel 21 is placed on the top surface plates 23B of the right and left side panels 23 and the top surface side of the upper frame 24. The bottom panel 22 is placed on the bottom surface plates 23C of the right and left side panels 23 and the bottom surface side of the lower frame 24. Rivets 26 are fastened at the respective overlapping portions of the plates at appropriate intervals. As a result, a box-like outer case body 28 is formed having openings on the anterior and posterior surfaces, as shown in FIG. 2. On the posterior surface of the outer case body 28 (the near side of FIG. 2), an opening edge portion 29A of a posterior opening 29 is formed by the flanges 21A and 22A (FIG. 3) of the top panel 21 and bottom panel 22, and posterior surface plates 23D (FIG. 3) of the right and left side panels 23.

The two panels, the left and right back panels 30L and 30R, are positioned to cover the posterior opening 29 of the outer case body 28.

Both of the back panels 30L and 30R are shaped substantially as quadrilateral parallelograms. Their vertical dimension is almost equal to height of the posterior surface of the outer case body 28, while their lateral dimension is longer than half of the frontage area of the posterior surface of the outer case body 28. Therefore, if the back panels 30L and 30R are positioned to fit around the opening edge portion 29A on the posterior surface of the outer case body 28, the right edge of the left back panel 30L overlaps the left edge of the right back panel 30R, according to the predetermined dimensions.

With regard to this embodiment, the left edge of the right back panel 30R can overlap an opposing surface of the right edge of the left back panels 30L. Subsequently, the right edge of the left back panel 30L is referenced as overlapping edge 31, and the left edge of the right back panel 30R is referenced as overlapping edge 32. The overlapping edges 31 and 32 of the left and right back panels 30L and 30R have bends 33 oppositely formed at a blunt angle with the free ends bent towards the opposing left and right back panels 30L and 30R side surfaces.

Rivet holes 35 are formed at appropriate intervals along the peripheries of both of the back panels 30L and 30R, except for the overlapping edges 31 and 32. Corresponding rivet holes 36 are also formed along the opening edge portion 29A on the posterior surface of the outer case body 28.

An example of a manufacturing procedure for the thermally insulated housing 10 will be described next. First, the outer case body 28, having the openings on the anterior and posterior surfaces, is formed as shown in FIG. 2. On the posterior surface of the outer case body 28, the right back panel 30R and the left back panel 30L are placed in this order. Rivets 26 fix the peripheries of the back panels 30L and 30R, except for the overlapping edges 31 and 32, along the opening edge portion 29A of the outer case body 28. Assembly of the outer case 20 is thereby completed.

Figure 4:
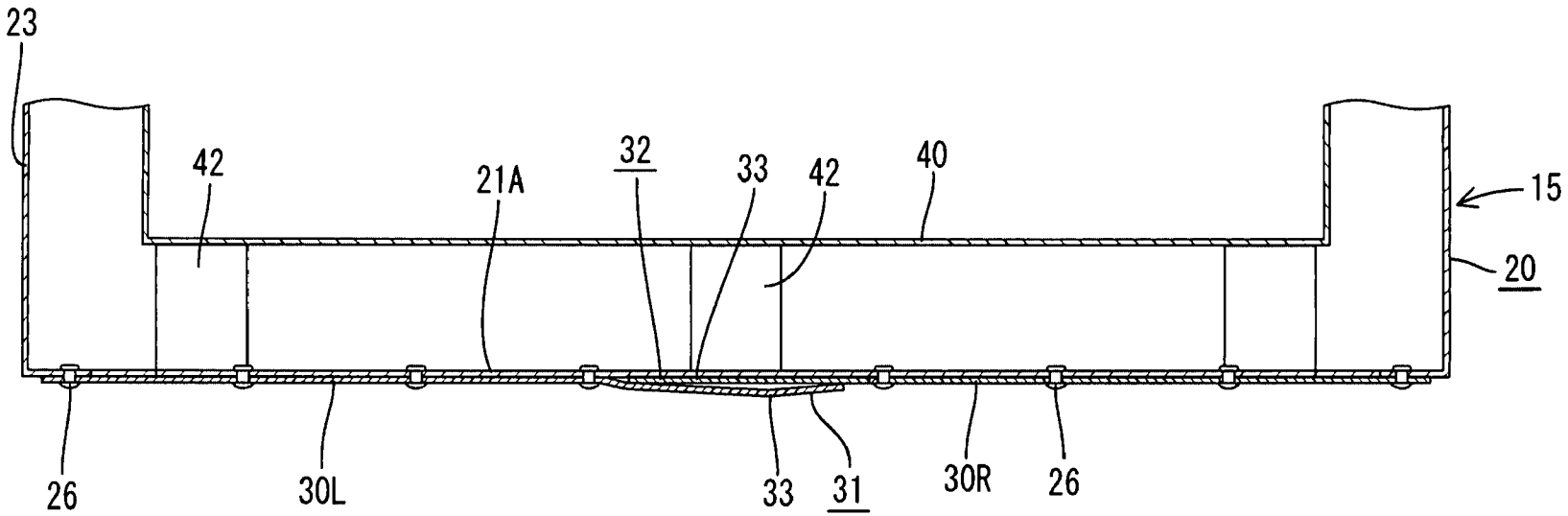
FIG. 4 is an X-to-X sectional view of an outer shell of FIG. 1 prior to charging with foam.
Figure 5:
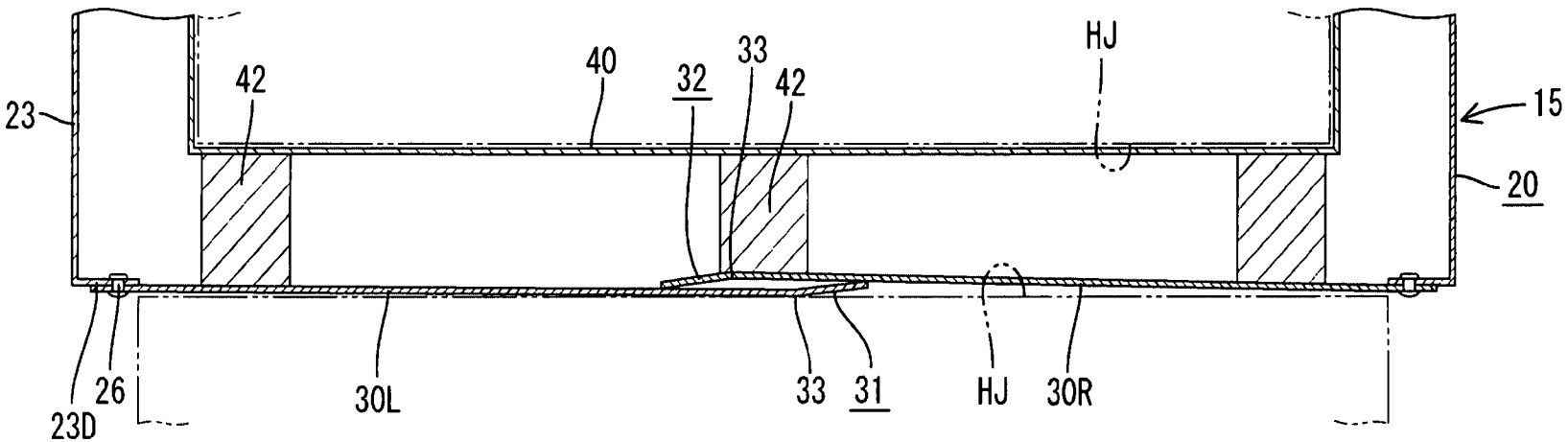
FIG. 5 is a Y-to-Y sectional view of the outer shell of FIG. 1 prior to charging with foam.

The overlapping edges 31 and 32 of the back panels 30L and 30R are overlapped in a condition of having the respective bends 33 deformed so as to be almost flat at the upper and lower ends, as shown in FIG. 4. For reference, as shown in FIG. 5 a central portion (with regard to the vertical direction) is in the state of having the overlapping edge 32 of the right (backside) back panel 30R pressed by the overlapping edge 31 of the left (front side) back panel 30L.

The inner case 40, which is like a box with an anterior opening and is one size smaller than the outer case 20, is housed at a predetermined interval inside of the outer case 20 that is assembled as previously described. As with the outer case 20, multiple panels composed of stainless steel plates are assembled to form the inner case 40. The inner case 40 may also be formed with a solid plate or integrally molded with a synthetic-resin material, depending on the size of the inner case 40.

Spacers 42 are mounted at appropriate intervals between the outer case 20 and the inner case 40 in order to set a predetermined interval between the outer case 20 and the inner case 40. The spacers 42 may be formed of blocks of styrofoam or the like, which is a thermally insulated material, so as to have the appropriate amounts of rigidity and elasticity.

As shown in FIG. 1, the spacers 42 are respectively mounted between the back surfaces of the outer case 20 and the inner case 40 for a total of nine locations, for example, corresponding to the top, middle, and bottom, at the right and left ends, and the center (with respect to the horizontal direction) of the posterior area. For instance, the spacers 42 may be affixed to the back surface of the inner case 40 in advance of assembly. Furthermore, as referenced in FIG. 5, the three spacers 42 at the center column are correspondingly positioned at substantially regular intervals along the overlapping edge 32 of the right (backside) back panel 30R.

Consequently, if the inner case 40, having the spacers 42 affixed thereon, is housed within the outer case 20 and the outer shell 15 is assembled, then the portion of the outer case 20 having the overlapping edges 31 and 32 of the left and right back panels 30L and 30R is put in a state in which, as shown in FIG. 5, the overlapping edge 32 of the front side back panel 30R is pressed by the overlapping edge 31 of the backside back panel 30L. The spacers 42 are positioned between the inner case 40 and the outer case 20 so that the overlapping edges 31 and 32 are put in close contact with each other while slightly deforming the spacers 42 and also deforming the bends 33 to be flatter.

The outer shell 15 thus assembled is set in the foaming jig HJ. For the back panel of the outer shell 15 for instance, the foaming jig HJ is placed along the outside of the back surface of the outer case 20, and along the inside of the front surface of the back of the inner case 40. Foam liquid is injected into the outer shell 15, that is, between the outer case 20 and the inner case 40, while in such a state. In this case, as previously described, the portion of the outer case 20 having the two joined back panels 30L and 30R is in a state in which the overlapping edge 31 of the backside back panel 30L is elastically pressed against the overlapping edge 32 of the front side back panel 30R. The foam liquid is received between the spacers 42 so that both of the overlapping edges 31 and 32 are put in close contact while deforming the bends 33. Therefore, there is no leakage of foam liquid from this joint.

Figure 6:
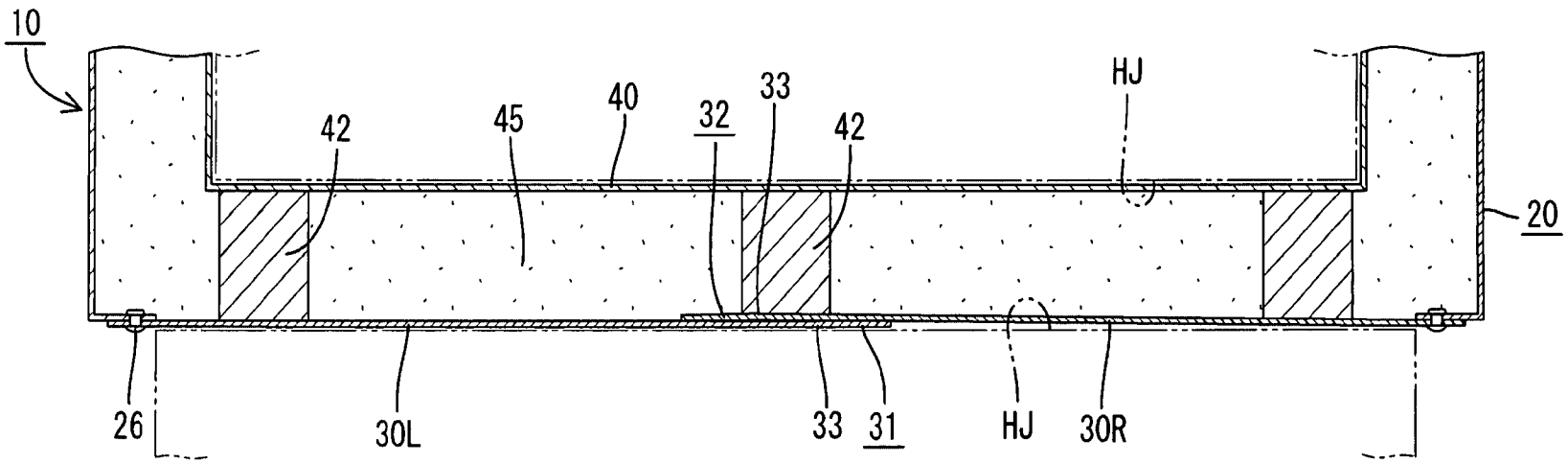
FIG. 6 is a Y-to-Y sectional view of FIG. 1 after charging with foam.

The foam insulation 45 is thereafter foamed between the outer case 20 and the inner case 40. However, as the outer case 20 and the inner case 40 are pressed by the foaming jig HJ, the overlapping edges 31 and 32 are urged in closer contact while further deforming both of the bends 33 to be flatter due to the pressure of the foam, as shown in FIG. 6. As a result, the sealing properties of the joint between the back panels 30L and 30R are secured during the manufacturing of the thermally insulated housing 10.

According to the previously described embodiment, it is possible to prevent the leakage of the foam liquid from the joint between the back panels 30L and 30R with a configuration of forming the back panel of the outer case 20 by joining two back panels 30L and 30R. In addition, the sealing properties of the joint can be secured without using any particular sealant or additional fasteners such as rivets. This allows the manufacturing of the thermally insulated housing 10 at a relatively low cost.

In particular, the manufacturing of the thermally insulated housing 10 is easy to handle because of the structure of simply bending the overlapping edges 31 and 32 of the back panels 30L and 30R at a blunt angle.

Second Embodiment

A second embodiment of the present invention will be described next by using FIGS. 7 and 8.

According to the second embodiment, the back panel of the outer case 20 is similarly configured by joining left and right back panels 50L and 50R. However, a change is made to the form of the overlapping edges of the back panels 50L and 50R.

Figure 7:
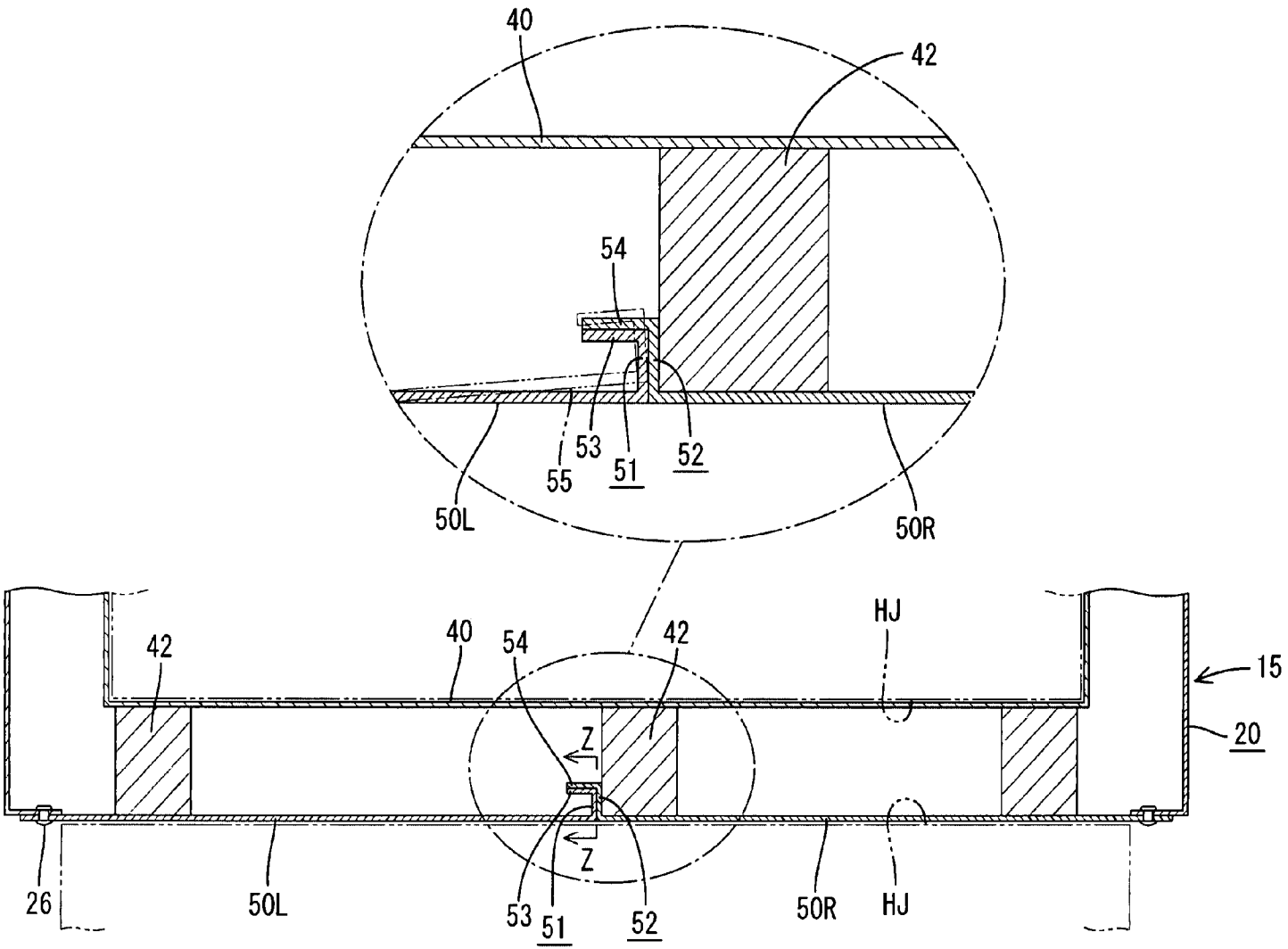
FIG. 7 is a sectional view of a back surface portion of the outer shell according to a second embodiment.
Figure 8:
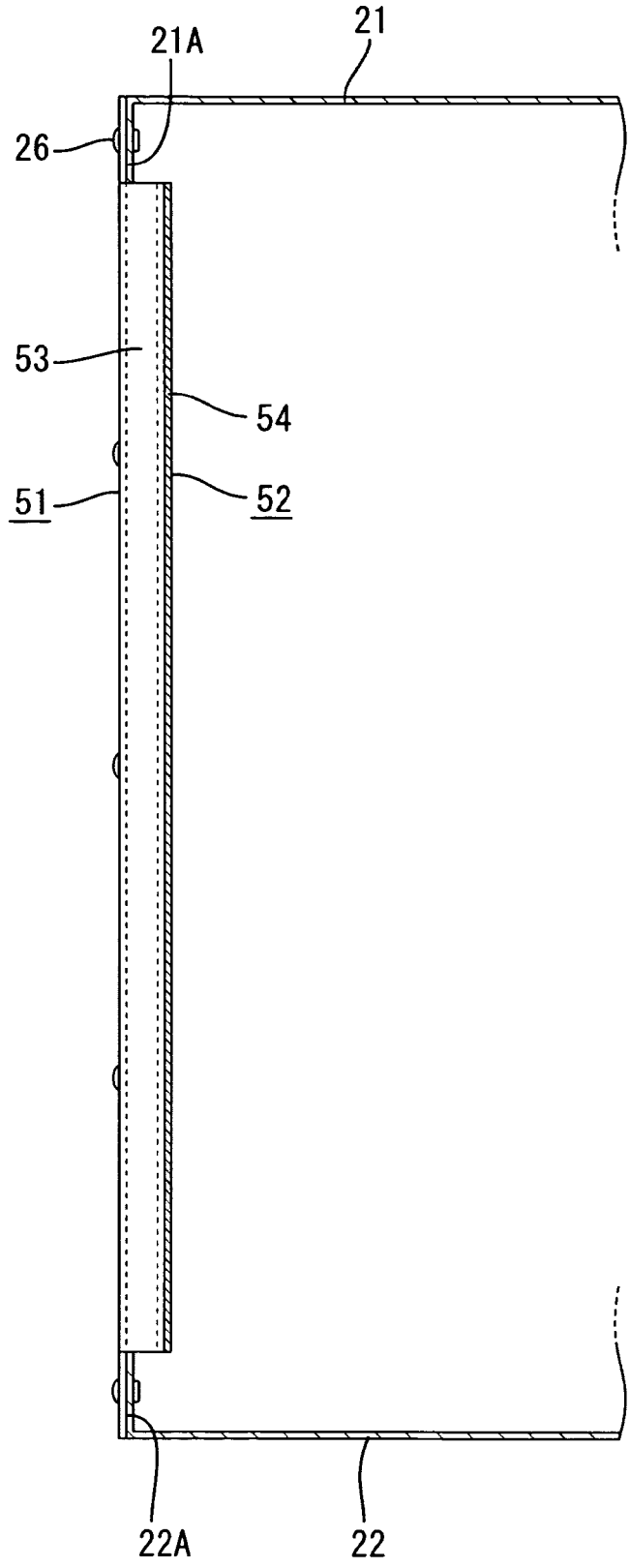
FIG. 8 is a Z-to-Z sectional view of FIG. 7.

As shown in FIG. 7, the left and right back panels 50L and 50R are mutually overlapping at portions of their right and left edges. However, FIG. 8 shows that the edges overlap except for an upper end and a lower end proximate to the upper edge and lower edge of the opening edge portion 29A, on the posterior surface of the outer case body 28.

An overlapping edge 51 of the left (backside) back panel 50L has a small hook portion 53 bent twice forward and leftward, substantially forming a right angle thereon. Likewise, an overlapping edge 52 of the right (front side) back panel 50R has a large hook portion 54 correspondingly one size larger and bent twice forward and leftward, also substantially forming a right angle thereon and allowing the small hook portion 53 to be covered by and fitted therein. As indicated by the chained lines in an enlarged view of FIG. 7, the overlapping edge 51 of the backside back panel 50L has the previously formed small hook portion 53 slightly bent in an inclined position projecting toward the front side of the thermally insulated housing 10. This inclined portion is equivalent to a bend 55 in the present invention. The spacers 42 are positioned proximate to the overlapping edge 52 of the front side back panel 50R.

According to the second embodiment, the inner case 40, having the spacers 42 affixed thereon, is housed within the outer case 20, thereby assembling the outer shell 15. Thereafter, the outer shell 15 is set in the foaming jig HJ to have foam liquid injected between the outer case 20 and the inner case 40. However, the portion of the outer case 20 having the two joined back panels 50L and 50R is in the state in which the overlapping edge 51 of the backside back panel 50L is elastically pressing against the overlapping edge 52 of the front side back panel 50R. The spacers 42 interact with the front side back panel 50R so that both the hook portions 53 and 54 are placed in close contact with each other while deforming the bend 55 to a substantially straight orientation. Therefore, the leakage of foam liquid from the joint is inhibited. After setting in the foaming jig HJ, the foam insulation 45 is foamed in between the outer case 20 and the inner case 40. However, as the cases are pressed by the foaming jig HJ, the hook portions 53 and 54 come in closer contact to each other due to the pressure of the foam. Consequently, the sealing properties of the joint formed by the back panels 50L and 50R are secured during the manufacturing of the thermally insulated housing 10.

Since both of the overlapping edges 51 and 52 are in close contact via a hook shape, further improvements are made in the functions of preventing the leakage of the foam liquid at the joint of the back panels 50L and 50R and the sealing of the joint after completion of the thermally insulated housing 10.

Third Embodiment

Figure 9:
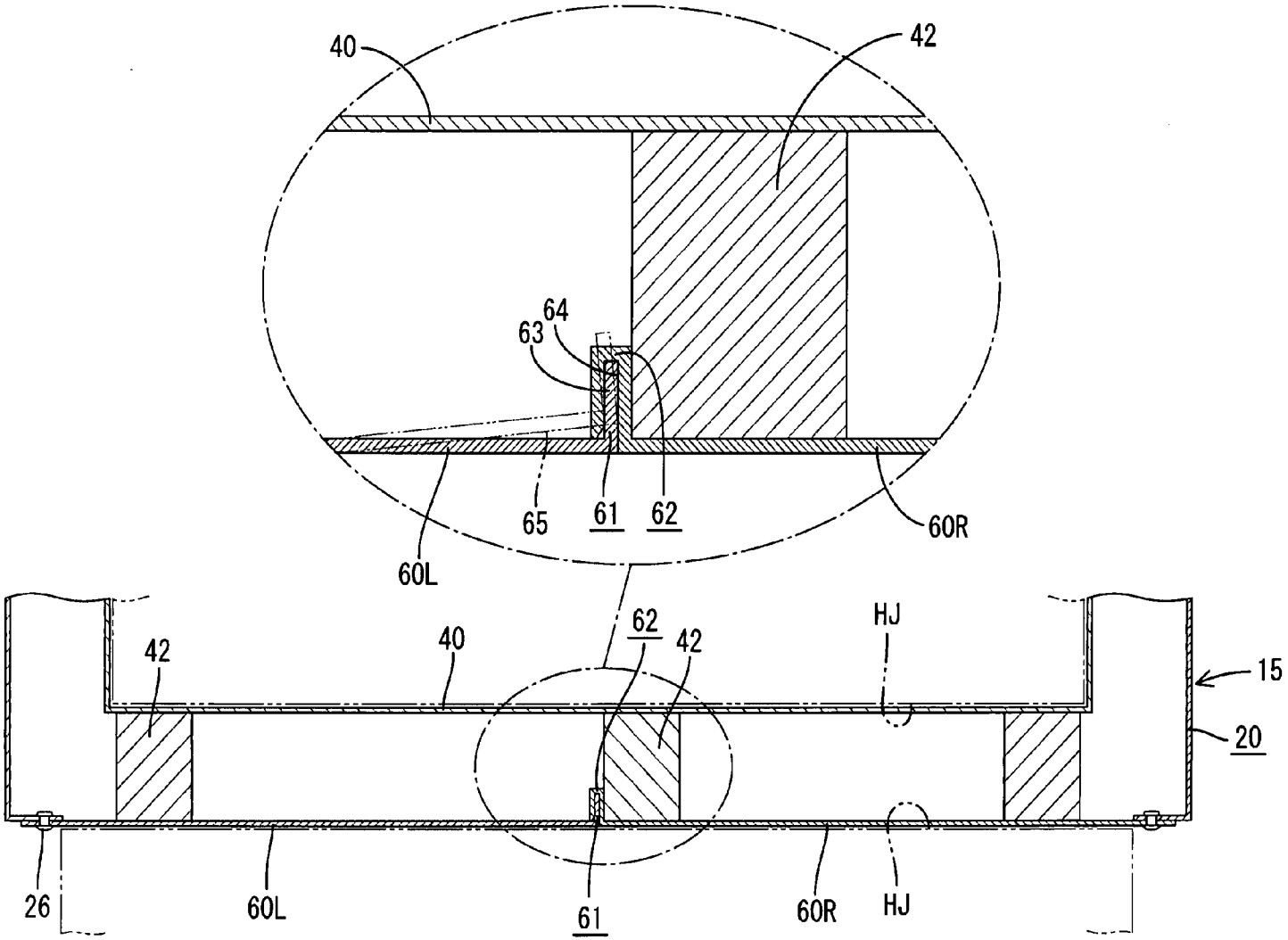
FIG. 9 is a sectional view of the back surface portion of the outer shell according to a third embodiment.

FIG. 9 shows a third embodiment of the present invention. According to the third embodiment, an overlapping edge 61 of a backside back panel 60L has an inserted piece 63 bent forward, substantially forming a right angle thereon. An overlapping edge 62 of a front side back panel 60R has an insertion groove 64 formed thereon. The insertion groove 64 is capable of having the inserted piece 63 inserted from the backside in substantially close contact. As indicated by the chained lines in the enlarged view of FIG. 9, the overlapping edge 61 of the backside back panel 60L has the inserted piece 63 formed bent in an inclined position slightly projecting inward. This inclined portion is equivalent to a bend 65 in the present invention. Similarly to previous embodiments, the spacers 42 are placed along the overlapping edge 62 of the front side back panel 60R.

According to the third embodiment, the portion of the outer case 20 having two joined back panels 60L and 60R is in a state in which the overlapping edge 61 of the backside back panel 60L is elastically pressing against the overlapping edge 62 of the front side back panel 60R. The front side back panel 60R interacts with the spacers 42 so that the inserted piece 63 is fitted in the insertion groove 64 while at least partially in close contact with a groove surface thereof, and deforming the bend 65 to a substantially straight orientation. Therefore, the leakage of the foam liquid from the joint is inhibited. Thereafter, the foam insulation 45 is foamed in between the outer case 20 and the inner case 40. However, as the cases are pressed by the foaming jig HJ, the inserted piece 63 and the groove surface of the insertion groove 64 come in closer contact with each other due to the pressure of the foam. Thus, the sealing properties of the joint between the back panels 60L and 60R are secured during the manufacturing of the thermally insulated housing 10.

As for the overlapping edges 61 and 62, the inserted piece 63 is fitted into the insertion groove 64 while at least partially in close contact with one another. As a result, a labyrinth structure is configured in addition to the close contact. Therefore, further improvements are made to the functions of preventing the leakage of the foam liquid at the joint of the back panels 60L and 60R and the sealing of the joint after the completion of the thermally insulated housing 10.

Other Embodiments

The present invention is not limited to the embodiments previously described by using the detailed descriptions and drawings, but may include the following embodiments, for example, within its technical scope. Furthermore, there may also be various embodiments other than the following by modifying the embodiments to an extent that does not deviate from the subject matter thereof.

(1) In the first embodiment, the bends may be formed on only one of the overlapping edges of the front side and backside back panels.

(2) In the second and third embodiments, the bends may be provided on the overlapping edge side of the backside back panel or on the overlapping edges of both the front side and the backside back panels.

(3) The surface formed by joining the divided panels is not limited to the back surface but may include or be another surface.

(4) The number of divisions of a surface may include three or more panels.

(5) The present invention is not only applicable to the outer case side configuring the thermally insulated housing, as exemplified in the detailed embodiments, but may also be applied to the inner case having at least one surface thereof formed by joining divided panels.

(6) The present invention is not only applicable to an thermally insulated housing configuring the body of a refrigerator used for business or commercial use, but may also be applicable to thermally insulated housings in general having at least one surface of an outer case and/or an inner case formed by mutually overlapping and joining the edges of multiple panels.

The invention claimed is:

1. A thermally insulated housing, comprising:

an outer shell including an outer case and an inner case that is housed at a spaced interval within the outer case, wherein a surface of one of the outer case and the inner case comprises a first panel and a second panel, the first and second panels being adjacent to each other, wherein an edge portion of the first panel and an edge portion of the second panel mutually overlap each other, at least one of the mutually overlapping edge portions of the first and second panels being bent at a blunt angle toward the other of the first and second panels;

a plurality of spacers disposed between the inner case and the outer case so as not to protrude through any of the inner case and the outer case, and being arranged between the at least one bent overlapping edge portion and the other of the outer case and the inner case for maintaining the at least one overlapping edge portion and the other of the first and second panels in a state in which the at least one bent overlapping edge portion is deformed so as to be flattened and so as to be in elastic close contact with the other of the first and second panels along only one plane; and foam insulation injected between the outer case and the inner case wherein each spacer has two mutually opposite ends, each of the ends having a contact surface, and wherein each spacer is arranged such that one of the contact surfaces is in contact with the at least one bent overlapping edge portion, and such that the other of the contact surfaces is in contact with an opposing flat surface of the other of the outer case and the inner case.

2. The thermally insulated housing according to claim 1, further comprising:

mechanical fasteners arranged so as to join surfaces of the first and second panels, other than the mutually overlapping edge portions, to other surfaces of the outer case and/or the inner case.

3. The thermally insulated housing according to claim 2, wherein two or more of the plurality of the spacers are placed in positions at regular intervals along a length direction of the mutually overlapping edge portions of the first and second panels.

4. The thermally insulated housing according to claim 1, wherein two or more of the plurality of the spacers are placed in positions at regular intervals along a length direction of the mutually overlapping edge portions of the first and second panels.

5. The thermally insulated housing according to claim 1, wherein the at least one bent overlapping edge portion comprises the overlapping edge portion of the first panel being bent at a blunt angle towards the second panel and the overlapping edge portion of the second panel being bent at a blunt angle towards the first panel.

6. The thermally insulated housing according to claim 5, wherein a portion of the plurality of the spacers are arranged along the bent overlapping edge portions of the first and second panels.

7. The thermally insulated housing according to claim 6, wherein two or more of the plurality of the spacers are placed in positions at regular intervals along a length direction of the mutually overlapping edge portions of the first and second panels.

8. The thermally insulated housing according to claim 5, wherein two or more of the plurality of the spacers are placed in positions at regular intervals along a length direction of the mutually overlapping edge portions of the first and second panels.

* * * * *